United States Patent [19]

Bost et al.

[11] Patent Number: 4,463,464

[45] Date of Patent: Aug. 7, 1984

[54] SMOLDER-RESISTANT UPHOLSTERY

[75] Inventors: Gretchen L. Bost, Hickory, N.C.; Hampton O. Powell, Altavista, Va.

[73] Assignee: The Lane Company, Inc., Altavista, Va.

[21] Appl. No.: 345,912

[22] Filed: Feb. 4, 1982

[51] Int. Cl.[3] ..... A47G 9/02

[52] U.S. Cl. ..... 5/459; 5/470; 5/483; 5/490

[58] Field of Search ..... 5/459, 483, 490, 470, 5/471, 474; 297/DIG. 5

[56] References Cited

U.S. PATENT DOCUMENTS

| | | | |
|---|---|---|---|
| 3,283,345 | 11/1966 | Berck | 5/471 |
| 3,813,715 | 6/1974 | Sookne | 5/459 |
| 3,818,520 | 6/1974 | Richards | 5/459 |
| 3,857,126 | 12/1974 | Woodruff | 5/459 |
| 3,889,305 | 6/1975 | Goldberg | 5/459 |
| 4,031,579 | 4/1977 | Larned | 5/459 |

FOREIGN PATENT DOCUMENTS

| | | | |
|---|---|---|---|
| 803923 | 11/1958 | United Kingdom | 5/490 |

*Primary Examiner*—Alexander Grosz

*Attorney, Agent, or Firm*—Cushman, Darby & Cushman

[57] ABSTRACT

Cushion covers of upholstered sofas and chairs and the like are rendered smolder-resistant by a process for the manufacture of the cushion covers in which the upholstery fabric is lined with a smolder-resistant material to completely surround the two welt cords and underlie the boxed, border or vertical, area of the cushion cover.

10 Claims, 10 Drawing Figures

SMOLDER-RESISTANT UPHOLSTERY

BACKGROUND OF THE INVENTION

The present invention is concerned with the provision of smolder-resistant cushion covers of upholstered furniture. A particularly important application of the invention is the provision of aesthetically pleasing structures that prevent ignition or charring of the welt cord and interior batting by a lighted cigarette or the like falling on the cushion.

It is well-known that many a fatal and/or otherwise disastrous fire results from a smoker falling asleep while smoking and his or her lighted cigarette dropping onto the upholstered furniture on which he or she is sitting. Unlike flash fires associated with inflammable clothing, an upholstered furniture fire is normally a slow-developing catastrophe which may involve asphyxiation of the smoker by fumes, together with smoke damage or even total loss by fire of the building involved. The problem is a very serious one, and numerous efforts have been made to develop effective flame-retardant barriers or the like. The objective of such conventional flameproofed barriers is generally to prevent ignition of the upholstered furniture during relatively short periods of exposure to open flame. In fact, practically all flameproofed fabrics, e.g. clothing, bed-clothes, bedding, protective uniforms, and the like, are designed for short exposures to open flame, the presumption being that the victim, given sufficient protection from a flash fire, will be able to move away from the source of flame in time to save himself or herself.

However, the cigarette falling from the mouth of a sleeper onto the upholstered furniture poses an entirely different problem from those dealt with in conventional other-than-furniture-upholstery uses of flame-retardant fabrics. Thus, in the usual instance of fire resulting from falling asleep while smoking there is an unusually long exposure of the fabric to the source of fire, the victim is asleep, and there is a large and concentrated source of combustibles exposed in the upholstered furniture covering substrates. It is in the smoldering, fume-producing, and sometimes eventually flaming substrates that the prime hazard most frequently lies.

Many smolder-resistant barrier materials have been developed such as polypropylene spun-bonded fabrics, aluminized materials, fiberglass materials and treated batting, etc. Also fire-resistant polyurethane foams have been developed to prevent ignitions. While many of these materials are successful when tested individually, none seem effective when placed with all the presently usually-used substrates of upholstered furniture coverings. The area most vulnerable to burning is the welt area where many layers of fabric are sewn with the welt allowing it to act as a wick. Also it is the welt area of the cushion where the batting tends to feather out and to be compressed, thereby lessening its value as a smolder-resistant barrier.

SUMMARY OF THE INVENTION

In a broad sense the invention comprises a way of upholstering furniture cushions with the cover fabric and a smolder-resistant material placed simultaneously in the border and welt cord areas.

It is an object of the present invention to provide upholstered furniture cushion covers which are resistant to ignition by a lighted cigarette.

It is another object of this invention to provide a process for making upholstered furniture smolder-resistant in an economical and effective manner.

It is another object of this invention to improve the appearance of upholstered furniture by providing a smoother, neater cushion border.

These and other objectives are achieved by the cushion cover border-treatment structure and providing-process of the present invention.

Cushion covers of upholstered sofas and chairs and the like are rendered smolder-resistant by a process for the manufacture of the cushion covers in which the upholstery fabric is lined with a smolder-resistant material to completely surround the two welt cords and underlie the boxed, border or vertical, area of the cushion cover.

In practicing the invention there is placed under the cover fabric, or upholstery fabric, of a cushion border and welt cord area a second layer which is made of a smolder-resistant material. Stated another way, the invention provides a smolder-resistant cover for a cushioned structure by placing a liner beneath the outer fabric and adjacent thereto, in the vertical side of the cushion and around the welt cords, the liner comprising a smolder-resistant material.

The smolder-resistant material used in this manner prevents heat from reaching the welt cord and allows a smoldering cigarette to self-extinguish without ignition of the cover or upholstery substrate materials.

The success of the invention appears to be due in considerable measure to the protection of the welt cord area of the cushion.

The principles of the invention will be further discussed with reference to the drawings wherein preferred embodiments are shown. The specifics illustrated in the drawings are intended to exemplify, rather than limit, aspects of the invention as defined in the claims.

DETAILED DESCRIPTION

For convenience and to facilitate understanding the drawings, some symbols are used, as follows: B is the bat, the not-yet-upholstered cushion, the stuffing; C is covering upholstery material; L is liner material; I is inside of the material, O is its outside; W is the welt cord.

Figure 1:
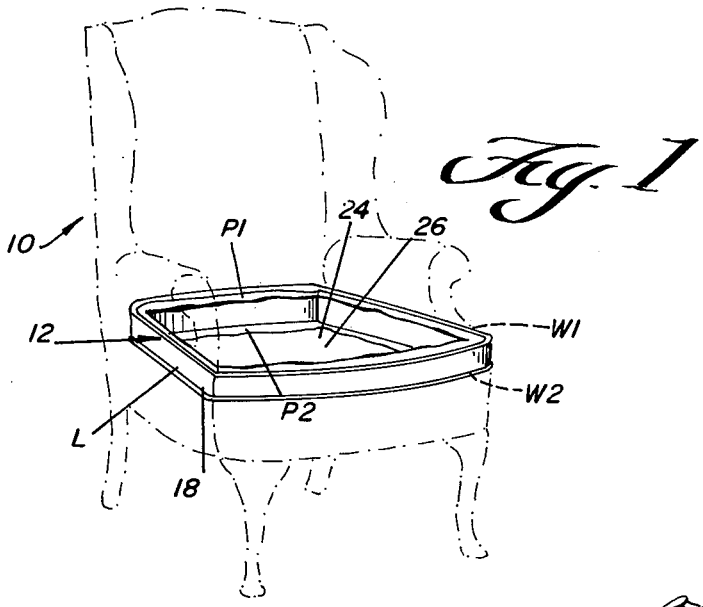
FIG. 1 is a phantom perspective view of an upholstered chair with only the liner of the invention being shown in full lines in order to clearly suggest just where it is that the inventors in the presently preferred embodiments of practicing their invention suggest that the liner be disposed under the cushion covering and over the welts.
Figure 8:
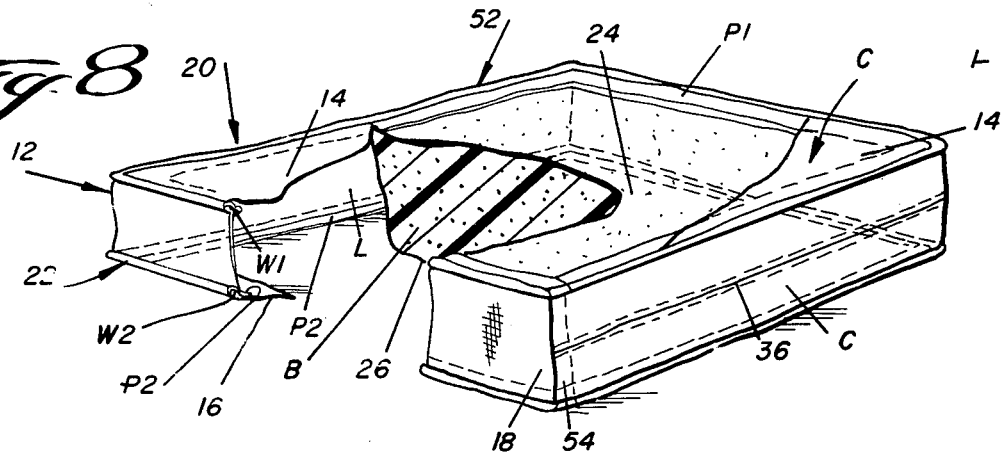
FIG. 8 is a perspective view of a boxed cushion which has been upholstered in accordance with the principles of the invention, a portion being broken away and sectioned to expose internal details.

Referring first to FIGS. 1 and 8, the chair 10 as shown is but an exemplary one of many different styles and types of upholstered individual and multiple seating units in the upholstering of which the principles of the invention may be used. The chair 10 is shown having a so-called "boxed" cushion 12 for its seat. The cushion may be of any conventional outline, such as square, rectangular, T-shaped, oval, squared front/rounded back, and the like. This cushion is comprised of a bat B with a covering C of upholstery material, typically a woven fabric. This covering may be made of utterly conventional material. The cover C include a top wall 14, a bottom wall 16, and a perimetrical sidewall 18. At the upper and lower perimetrical corners 20, 22 where the sidewall 18 respectively adjoins the top wall 14 and the bottom wall 16, the covering C incorporates a respective welt cord W1, W2.

What is different about the upholstering process and upholstered product of the present invention is that the welt cords W1 and W2, in addition to being covered by the covering C are covered with a liner L of smolder-proof material which also lines the covering C where the covering C covers the welt cords, where the covering C provides the sidewall 18 and also narrow outer perimetrical bands P1 and P2, respectively of the top wall covering 14 and the bottom wall covering 16. This lining preferably does not also extend under the central areas 24, 26, of the top and bottom wall coverings 14, 16. The lining L is not incorporated into the bat B, although it could be provided in instances where the bat B is also composed or treated in any known manner. The lining L is not provided directly as a preliminary, base or under-lining of the bat B, although it could be provided in instances where the bat B was first given a preliminary, base or under-lining in any known manner. Preferably, the lining L is not provided as a back-coating of the covering C, nor a preliminary, base or under-coating of the welt cord W. Rather, the lining L preferably is sewn onto the inside of certain parts of the covering C and sewn about the welt W and further sewn into a boxed cushion covering in a series of steps as will now be explained further with reference to FIGS. 2–7 and then 8.

Figure 2:
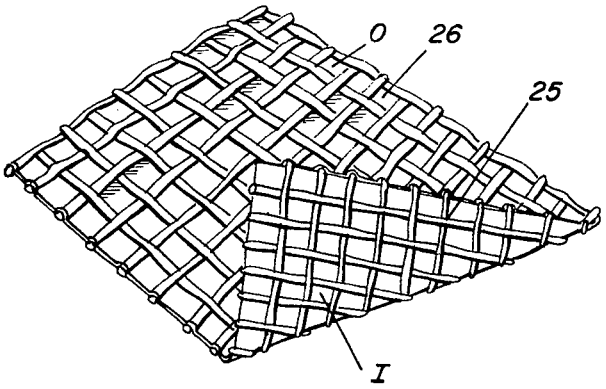
FIG. 2 is a perspective view of a small swatch of a first type of liner material, aluminized scrim.
Figure 3:
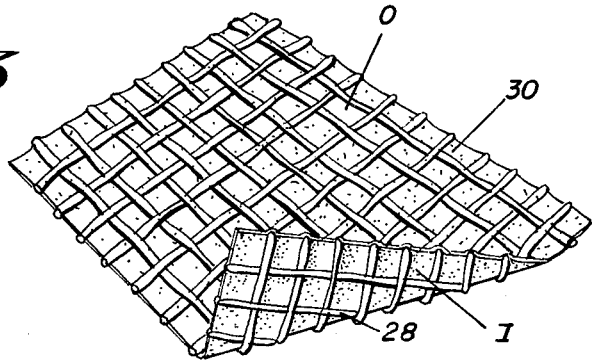
FIG. 3 is a perspective view of a small swatch of a second type of liner material, chemically treated cloth.

Referring to FIGS. 2 and 3, there are two notably effective ways for imparting a smolder-resistance quality to lined upholstery. One way is to lead heat away from the burning cigarette and from the place where it has landed on the upholstered furniture. This may be done, e.g. by using a lining made of a woven or non-woven fabric substrate 25 coated on its outer face with a layer of a non-combustible, good conductor of heat, e.g. aluminum 26, e.g. an aluminized woven scrim. Another way is to coat or impregnate a woven or non-woven lining fabric 28 with a chemical 30, e.g. by spraying or dipping, and drying, which chemical gives-off a flame-extinguishing gas upon exposure to heat typical of a smoldering cigarette. Neither lining material is new with the present invention, linings of both types are commercially offered and a large number of prior U.S. patents have been granted thereon. For instance, an exemplary aluminized scrim liner material is disclosed in the U.S. patent of May, U.S. Pat. No. Re. 29,630, reissued May 16, 1978. An exemplary chemically-treated lining material is disclosed in the U.S. patent of Wagner, U.S. Pat. No. 4,154,890, issued May 15, 1979.

Once the lining of FIG. 2 or FIG. 3 is prepared, it may be used in the upholstering method described hereunder in exactly the same manner, regardless of which type it is. Where the structure which imparts the smolder resistant quality is laminated to or coated upon the lining fabric rather than soaked into it, the lining has a definite outside, i.e. the face which is coated or bears the foil laminate and, in upholstering care needs to be taken to ensure that the lining is used in a way which results in that face being presented outwards.

Since the smolder-resistant liner is shielded by the upholstery from exterior contact and visibility it need be neither attractive in appearance nor particularly resistant to wear. A chemically treated liner should be natural, or ecru, in color or of any other color which in no way detracts from the appearance of the finished cushion. An aluminized smolder-resistant liner will not effect the finished appearance even under a thin light-weight cotton cover fabric such as chintz, but the aluminized material should be resistant to flaking. Either the chemically treated or aluminized liner will give a thin cotton cover fabric such as chintz a better finished cushion border appearance.

Figure 4:
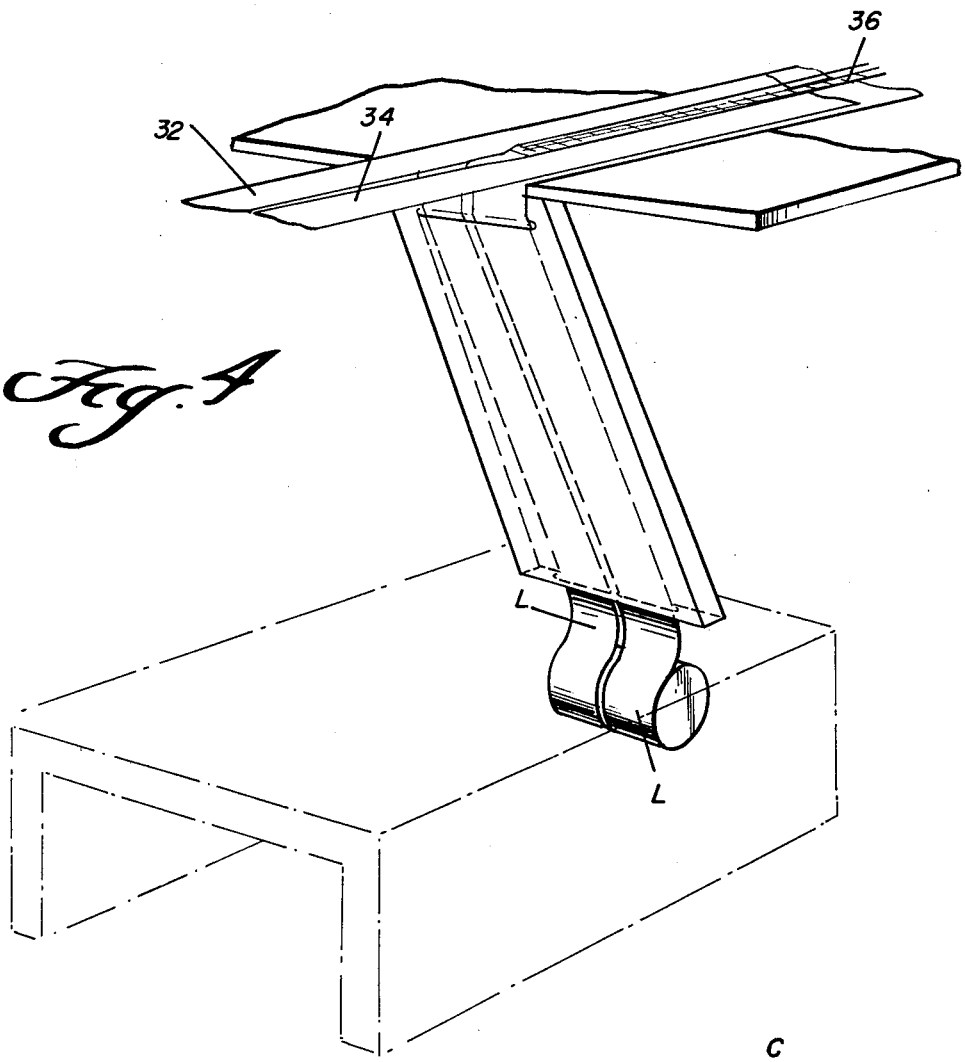
FIG. 4 is a fragmentary perspective schematic representation of an initial step in practicing either the first or second embodiment of the present invention: juxtaposing liner strips with covering strips for the zippered interval of the cushion sidewall.
Figure 5:
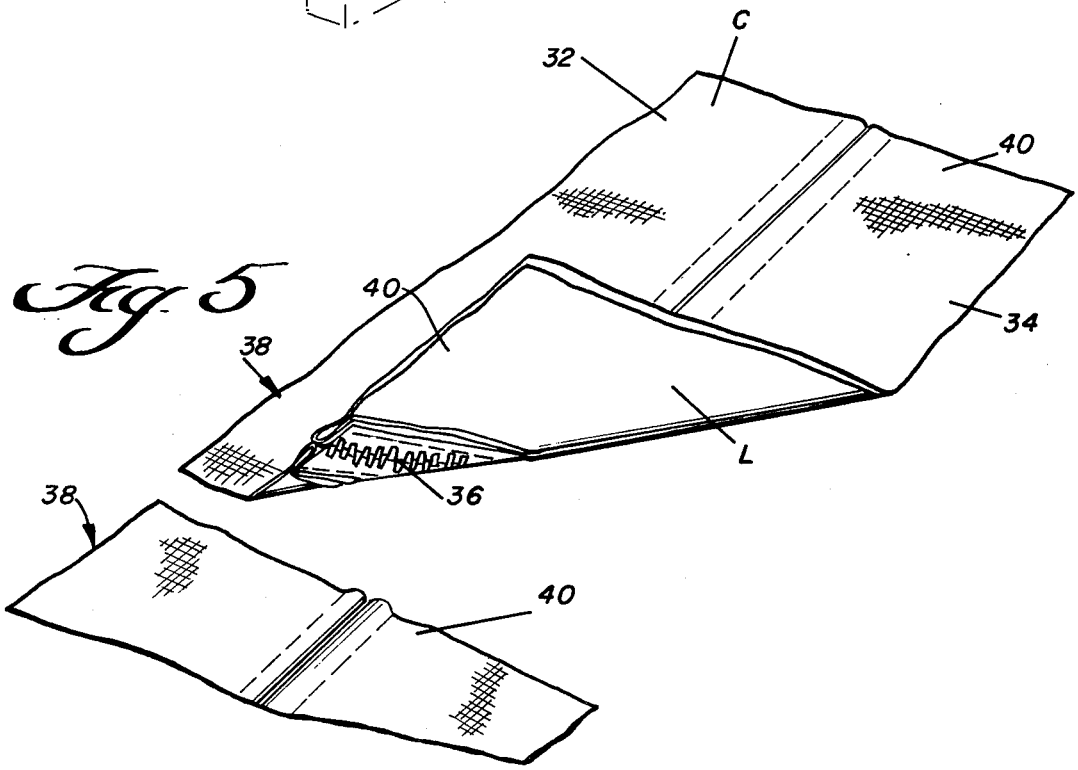
FIG. 5 is a fragmentary perspective schematic representation of a further step, in which the zipper is sewn-in along its sides.
Figure 6:
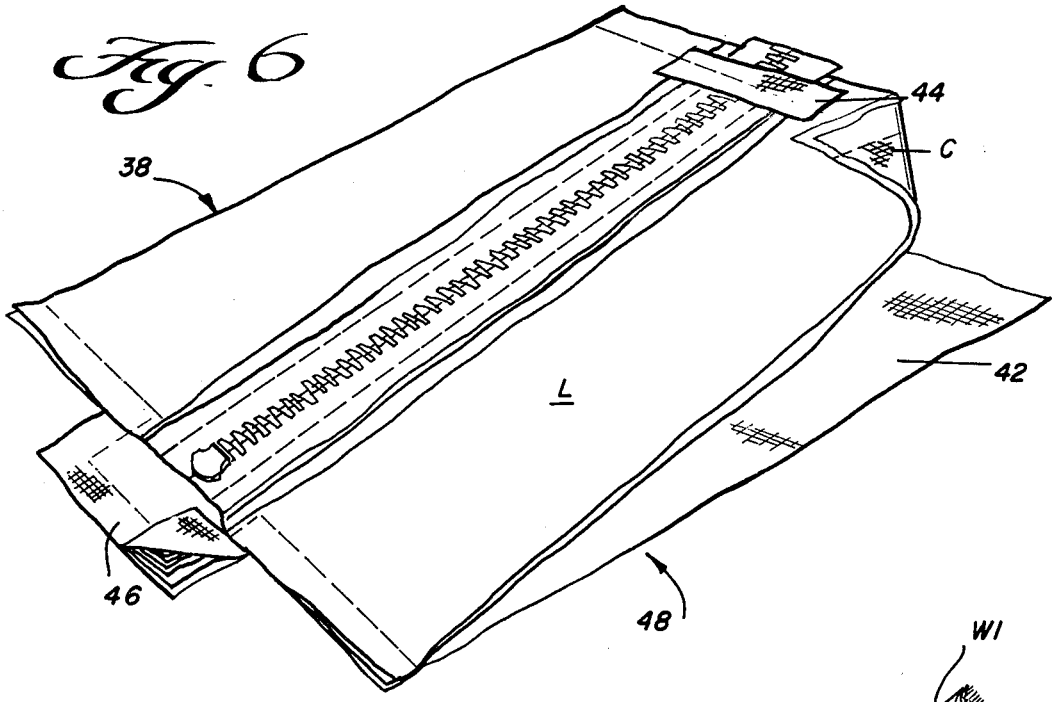
FIG. 6 is a fragmentary perspective schematic representation of a further step in which the zipper is provided with ends, and one end of the strip that will become the cover portion of the non-zippered interval of the cushion sidewall is sewn to an end of the lined zipper interval.

Referring to FIG. 4, as in the usual manner of making a cushion cover, two widths of cover fabric 32, 34 are cut to be attached on either side of a zipper 36. The present invention adds a smolder-resistant material adjacent to and beneath the cover fabric. To conveniently feed this smolder-resistant material it is suggested that the sewing machine table be placed on a platform open at the front and back ends. In the area under the platform and in front of the sewing machine table two rolls of the smolder-resistant material L (to be the same width as the two pieces of cover fabric 32, 34) are mounted with a space between them equal to the width of the zipper. The smolder-resistant material is fed from the rolls through a metal trough which extends from openings in the top side of the platform in front of the sewing machine table under the table to its upper edge directly in front of the operator. The smolder-resistant material then is fed into the sewing machine directly under the cover fabric 32, 34. The zipper 36 is sewn to the cover fabric and smolder-resistant material simultaneously. The resulting composite is cut into lengths 38 (FIG. 5) corresponding to the length of the zippered interval of the perimetrical sidewall, plus end margins 40 for seaming. This completed zipper assembly is then attached to the remainder of the border at one end margin to strip 42 of cover fabric which has not yet been lined, by placing the border strip 42 face up on the sewing table and the zipper assembly 38 face down on top of the unlined border piece. The operator makes the usual tab 44 at this zipper slide end placing and sewing a respective small piece of fabric 46 over the zipper end. This creates a further assembly 48, shown in FIG. 6, of which the zipper assembly 38 constitutes a head end and the not-yet-lined upholstery strip 42 constitutes the tail end.

It is at this stage that the FIGS. 7, 8 and FIGS. 9, 10 species diverge.

Figure 7:
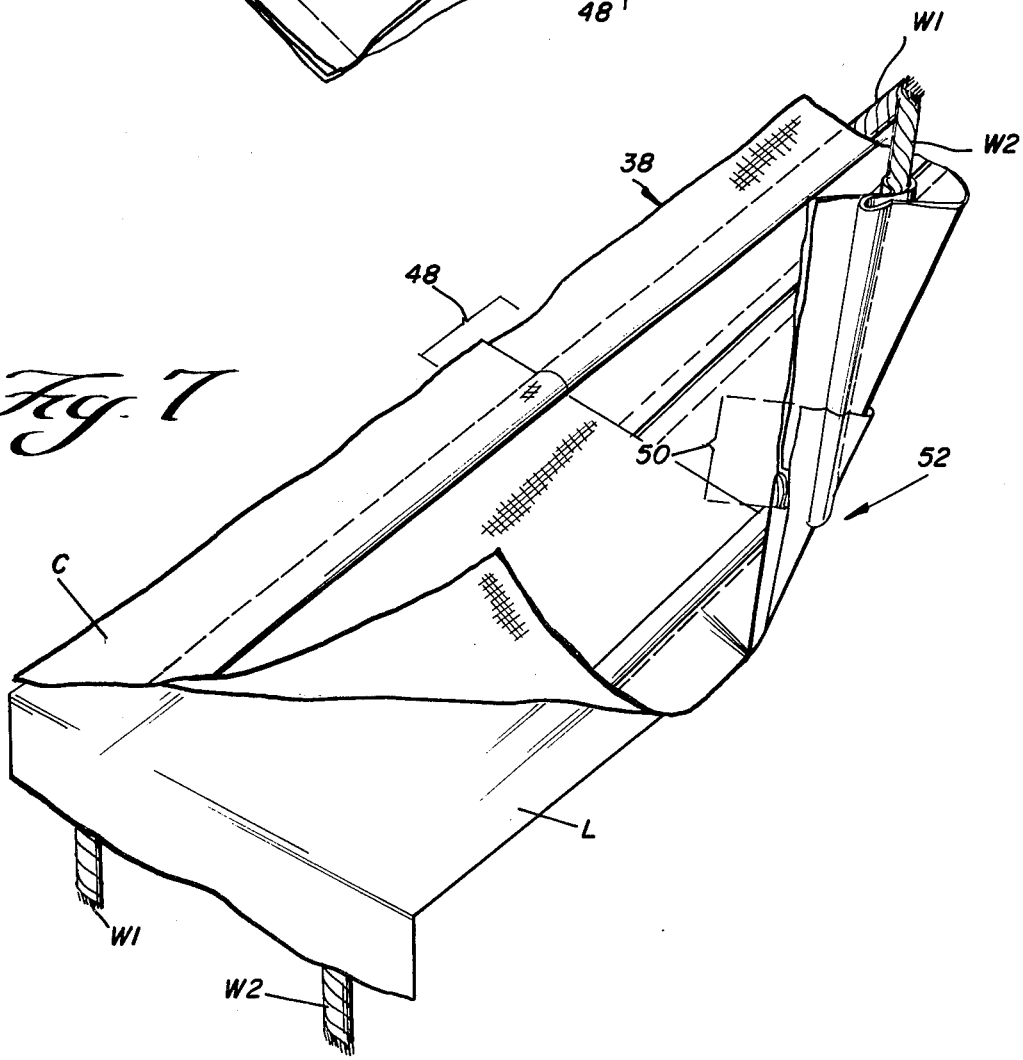
FIG. 7 shows in fragmentary perspective a subsequent step according to a first embodiment of the invention, in which the welt cords are to be covered with the same outer covering upholstery material as the cushion sidewall.

Referring first to FIG. 7, to completely line the cover fabric C in what will become the sidewall 18 and the perimetrical bands P1, P2 of the top and bottom walls of the upholstery of the cushion 12, as well as to simultaneously line the cover fabric where it surrounds the welt cords W1 and W2, in an instance where the upholstery in this region is to be all of the same appearance, the tail end of the assembly 48 is juxtaposed with the end of a strip of the liner material L and fed into a conventional folding machine, together with the two welt cords W1 and W2.

To conveniently achieve this, it is suggested that a sewing machine table be placed on a platform open at the front and back ends. In the area under the platform and in front of the sewing machine a roll of smolder-resistant material L to be the same width as the assembly 48 is mounted. The smolder-resistant material L is fed from the roll through a metal trough which extends from an opening in the top side of the platform in front of the sewing machine table under the table to its upper edge directly in front of the operator. At this end of the trough a portable tray hooks to the trough and extends toward the operator the same length as a folding machine attachment. The smolder-resistant material L then is fed into the folding machine together with and directly under the cover fabric C of the tail end of 48 along with the welt cords W1 and W2. The folding machine folds those two layers over the welt cords. When the operator comes to the zipper assembly 38 already at the end which has been lined, the supply of smolder-resistant material is cut-off from the roll allowing about a 1½ inch overlap at 50, and the assembly 38 of the border continues through the folding machine to cover the welt cords W1, W2 of that part of the assembly 48. At the head end, the supply rolls of welt cords W1, W2 are cut-off leaving as a finished product a long composite strip 52 which may be sewn along its margins, right next to the covered welt cords, to the respective perimetrical margins of the squares (or the like) of material of the top wall 14 and bottom wall 16 for a cushion covering, and the head end margin and tail end margin of the strip 52 are sewn together at 54 to complete the cushion covering.

By preference, the top wall 14 and bottom wall 16 remain unlined by the liner L, except in the marginal portions of about one-half inch in width where the marginal bands P1 and P2 of the liner L become disposed under the fabric of the margins of these walls of the cushion covering. The cushion is completed by inserting the bat B and zipping the zipper 36 closed. The resulting construction is shown in FIG. 8.

Figure 9:
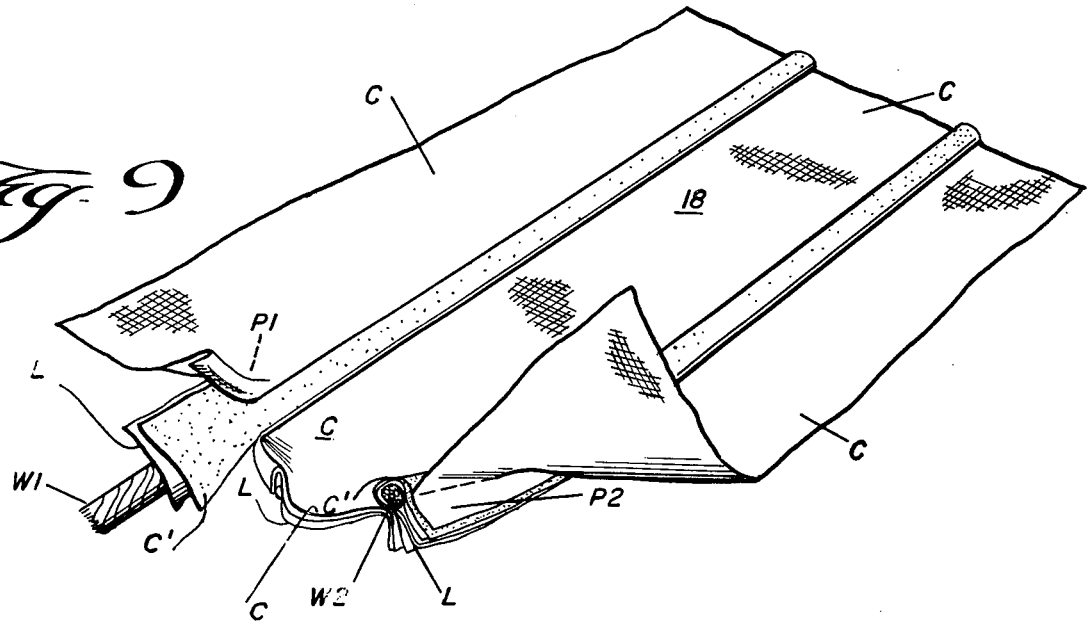
FIG. 9 shows in fragmentary perspective a subsequent step according to a second embodiment of the invention, in which the welt cords are separately covered with an outer covering of upholstery material which may be different from that used for covering the cushion sidewall.

Referring next to FIG. 9, to completely line the cover fabric C in what will become the sidewall 18 and the perimetrical bands P1, P2 of the top and bottom walls of the upholstery 12, as well as to line the cover fabric where it surrounds the welt cords W1 and W2, in an instance where the welt cords are to be covered with a covering upholstery fabric that contrasts in type of color or the like with the upholstery of the sidewall 18, a somewhat different technique is employed.

First, a supply of each welt cord W is covered simultaneously with the desired upholstery fabric C′ and liner L by juxtaposing a narrow strip of the fabric C′ upon a narrow strip of the liner L and feeding an end of this composite into a conventional single folding machine together with an end of the welt cord stock. Except that it is a single folder, the folding and sewing may be accomplished as set forth hereinabove with regard to the double folder and sewing machine. Next, a respective length of this covered welt cord C′ W1 and C′ W2 is sewn to each margin of the assembly 48 of FIG. 6, leaving as a finished product a long composite strip 56 which may be sewn along its margins, right next to the covered welt cords C′ W1 and C′ W2, to the respective perimetrical margins of the squares (or the like) of material of the top wall 14 and bottom wall 16 for a cushion covering, and the head end margin and tail end margin of the strip 56 are sewn together at 58 to complete the cushion covering.

Figure 10:
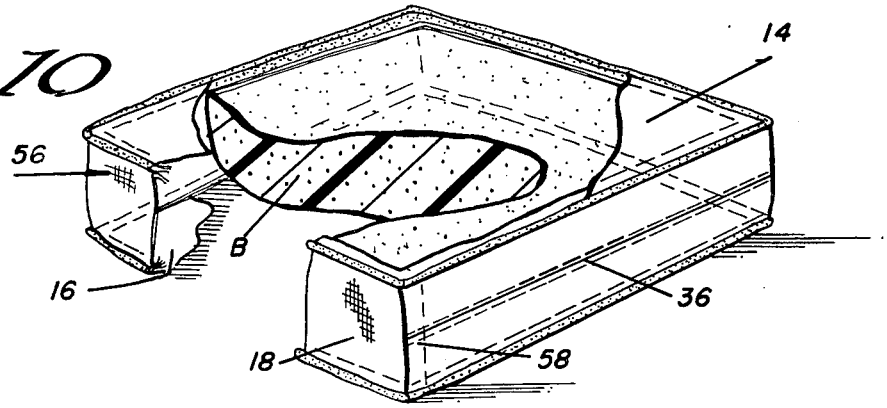
FIG. 10 is a perspective view of a boxed cushion which has been upholstered in accordance with the principles of the invention, a portion being broken away and sectioned to expose internal details.

By preference, in the FIGS. 9 and 10 embodiment, the top wall 14 and bottom wall 16 remain unlined as with the FIGS. 7 and 8 embodiment, except in the same marginal regions P1 and P2. The cushion of FIG. 10 is completed by inserting the bat B and zipping the zipper 36 closed.

The process of the invention could be modified as will be understood by those skilled in the art to make similar boxed cushions having other closures than zippers, or which are sewn closed and/or which have some seams which are glued, sonically welded or the like.

It should now be apparent that the smolder-resistant upholstery as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. For upholstering the bat of a boxed cushion, where the upholstery conventionally includes a unitized body of upholstery material including a top wall, a bottom wall, a perimetrical sidewall, an upper perimetrical welt portion enclosing an upper welt cord, and a lower perimetrical welt portion enclosing a lower welt cord, the upholstery improvement comprising:

a liner of lining material having means imparting a smolder-resistant quality thereto, said liner lining said perimetrical sidewall of said unitized body of upholstery material, both said perimetrical welt portions of said unitized body of upholstery material and only a respective perimetrical marginal portion of about a half inch in width of each of said top wall and said bottom wall of said unitized body of upholstery material;

extending in a perimetrical direction, said sidewall including a zippered interval and a non-zippered interval;

in said zippered interval, two respective strips of said liner having respective medial side margins sewn to respective side margins of a zipper jointly with respective medial side margins of two respective strips of upholstery material; and in said non-zippered interval, a strip of said liner being juxtaposed with a respective strip of upholstery material and the resulting composite is sewn at one end to a respective one end of all four of said strips of said zippered interval and at the opposite end to a respective opposite end of said four strips of said zippered interval.

2. The improved upholstery of claim 1, wherein:

adjacent the upper margin of the sidewall, both the respective strips of upholstery material and the respective strips of liner, in both said zippered interval and in said non-zippered interval together encircle the upper welt cord and are sewn together under the welt cord, leaving an upper flange which provides the upper said perimetrical marginal portion of liner of about a half inch in width; and adjacent the lower margin of the sidewall, both the respective strips of upholstery material and the respective strips of liner, in both said zippered interval and in said non-zippered interval together encircle the lower welt cord and are sewn together over that welt cord, leaving a lower flange which provides the lower said perimetrical marginal portion of liner of about a half inch in width.

3. The improved upholstery of claim 2, wherein:

said upper flange is sewn perimetrically to the perimetrical margin of said top wall of upholstery material next to said upper welt cord; and said lower flange is sewn perimetrically to the perimetrical margin of said bottom wall of upholstery material next to said lower welt cord.

4. The improved upholstery of claim 1, wherein:

the unitized body includes a strip of upholstery material juxtaposed with a strip of said liner to create a composite that is wrapped about the upper welt cord and sewn to itself to provide an upper upholstered welt cord with an upper flange;

the unitized body includes a strip of upholstery material juxtaposed with a strip of said liner to create a composite that is wrapped about the lower welt cord and sewn to itself to provide a lower upholstered welt cord with a lower flange;

adjacent the upper margin of the sidewall, both the respective strips of upholstery material and the respective strips of liner in both said zippered interval and in said non-zippered interval are sewn together and perimetrically to the perimetrical margin of said top wall of upholstery material through said upper flange next to said upper upholstered welt cord; and adjacent the lower margin of the sidewall, both the respective strips of upholstery material and the respective strips of liner in both said zippered interval and in said non-zippered interval are sewn together and perimetrically to the peripheral margin of said bottom wall of upholstery material through said lower flange next to said lower upholstered welt cord.

5. The improved upholstery of any one of claims 1, 2, 3 or 4 in which:

the means imparting a smolder-resistant quality to the lining material of said liner is a coating of aluminum foil on the outside face of said lining material.

6. The improved upholstery of any one of claims 1, 2, 3 or 4 in which:

the means imparting a smolder-resistant quality to the lining material is an at least partial impregnation from upon at least the outside face of said lining material of a chemical which gives off a combustion-extinguishing gas upon being subject to heating typical of a smoldering cigarette landing upon said upholstery.

7. A method for upholstering the bat of a boxed cushion, where the upholstery conventionally includes a unitized body of upholstery material including a top wall, a bottom wall, a perimetrical sidewall, an upper perimetrical welt portion enclosing an upper welt cord, and a lower perimetrical welt portion enclosing a lower welt cord, said method comprising:

providing said utilized body with a liner of lining material having a smolder resistant quality imparted thereto, so that said liner lines said perimetrical sidewall of said unitized body of upholstery material, both said perimetrical welt portions of said unitized body of upholstery material and only a respective perimetrical marginal portion of about a half inch in width of each of said top wall and said bottom wall of said unitized body of upholstery material;

extending in a perimetrical direction, said sidewall including a zippered interval and a non-zippered interval;

in said zippered interval, two respective strips of said liner having respective medial side margins sewn to respective side margins of a zipper jointly with respective medial side margins of two respective strips of upholstery material; and in said non-zippered interval, a strip of said liner being juxtaposed with a respective strip of upholstery material and the resulting composite is sewn at one end to a respective one end of all four of said strips of said zippered interval and at the opposite end to a respective opposite end of said four strips of said zippered interval.

8. The method of claim 7, wherein:

adjacent the upper margin of the sidewall, both the respective strips of upholstery material and the respective strips of liner, in both said zippered interval and in said non-zippered interval together encircle the upper welt cord and are sewn together under that welt cord, leaving an upper flange which provides the upper said perimetrical marginal portion of liner of about a half inch in width; and adjacent the lower margin of the sidewall, both the respective strips of upholstery material and the respective strips of liner, in both said zippered interval and in said non-zippered interval together encircle the lower welt cord and are sewn together over that welt cord, leaving a lower flange which provides the lower said perimetrical marginal portion of liner of about a half inch in width.

9. The method of claim 8, wherein:

said upper flange is sewn perimetrically to the perimetrical margin of said top wall of upholstery material next to said upper welt cord; and said lower flange is sewn perimetrically to the perimetrical margin of said bottom wall of upholstery material next to said lower welt cord.

10. The method of claim 7, wherein:

the unitized body includes a strip of upholstery material juxtaposed with a strip of said liner to create a composite that is wrapped about the upper welt cord and sewn to itself to provide an upper upholstered welt cord with an upper flange;

the unitized body includes a strip of upholstery material juxtaposed with a strip of said liner to create a composite that is wrapped about the lower welt cord and sewn to itself to provide a lower upholstered welt cord with a lower flange;

adjacent the upper margin of the sidewall, both the respective strips of upholstery material and the respective strips of liner in both said zippered interval and in said non-zippered interval are sewn together and perimetrically to the perimetrical margin of said top wall of upholstery material through said upper flange next to said upper upholstered welt cord; and adjacent the lower margin of the sidewall, both the respective strips of upholstery material and the respective strips of liner in both said zippered interval and in said non-zippered interval are sewn together and perimetrically to the peripheral margin of said bottom wall of upholstery material through said lower flange next to said lower upholstered welt cord.

* * * * *